US007503643B2

(12) United States Patent
Sanada

(10) Patent No.: US 7,503,643 B2
(45) Date of Patent: Mar. 17, 2009

(54) LIQUID DROPLET DISCHARGE HEAD AND IMAGE FORMING APPARATUS

(75) Inventor: Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 346 days.

(21) Appl. No.: 11/093,305

(22) Filed: Mar. 30, 2005

(65) Prior Publication Data

US 2005/0219329 A1 Oct. 6, 2005

(30) Foreign Application Priority Data

Mar. 31, 2004 (JP) ..... 2004-107850

(51) Int. Cl.
*B41J 2/045* (2006.01)

(52) U.S. Cl. ..... 347/68; 347/65

(58) Field of Classification Search ..... 347/15, 347/21, 7, 68–725
See application file for complete search history.

(56) References Cited

U.S. PATENT DOCUMENTS 6,322,203 B1 11/2001 Kitahara
2002/0018095 A1* 2/2002 Nakamura et al. ..... 347/40
2003/0179258 A1* 9/2003 Freire et al. ..... 347/20

FOREIGN PATENT DOCUMENTS

JP 60-115457 A 6/1985
JP 63-242554 A 10/1988
JP 02-111548 A 4/1990
JP 2000-43267 A 2/2000
JP 2000-141656 A 5/2000
JP 2000141656 A * 5/2000
JP 2001-260347 A 9/2001

* cited by examiner

*Primary Examiner*—Manish S Shah
(74) *Attorney, Agent, or Firm*—Birch, Stewart, Kolasch & Birch, LLP

(57) ABSTRACT

A liquid droplet discharge head having a first pressure chamber filled with a fluid; an actuator is displaced on at least one portion of a surface defining a first pressure chamber; a nozzle for discharging droplets of a discharge liquid; a second pressure chamber connected to the nozzle and is filled with the discharge liquid to be discharged from the nozzle; a liquid supply path which supplies the discharge liquid to the second pressure chamber; and a pressure transmitting section which transmits pressure generated in the first pressure chamber to the second pressure chamber by driving the actuator, so as to satisfy the relationship, S1>S2, wherein S1 is the application force applied to the first pressure chamber by the actuator, and S2 is the application force applied to the second pressure chamber by the pressure transmitting section; and the droplet of the discharge liquid is discharged from the nozzle by means of a discharge force being applied to the discharge liquid inside the second pressure chamber through the pressure transmitting section.

19 Claims, 12 Drawing Sheets

LIQUID DROPLET DISCHARGE HEAD AND IMAGE FORMING APPARATUS

BACKGROUND OF THE INVENTION

1. Field of the Invention

The present invention relates to a liquid droplet discharge head and an image forming apparatus, and more particularly, to a structure of a liquid droplet discharge head which discharges liquid droplets from nozzles by applying pressure to liquid by driving actuators, and an inkjet recording apparatus or other image forming apparatus using a liquid droplet discharge head of this kind.

2. Description of the Related Art

Japanese Patent Application Publication No. 60-115457 discloses an inkjet head having a structure in which the minute vibrational displacement of a piezoelectric diaphragm is transmitted to a passive diaphragm of small surface area by means of a horn-shaped displacement amplifying chamber, thereby causing ink inside an ink chamber which is positioned in front of the passive diaphragm to be discharged from an orifice (liquid droplet discharge port).

Japanese Patent Application Publication No. 2000-43267 discloses an inkjet head comprising two pressure generating chambers for each nozzle, in order to increase the speed of ink refilling to the pressure generating chambers after ink discharge. This head is provided with a first pressure generating chamber and a second pressure generating chamber connected to a common ink chamber (reservoir), these two pressure generating chambers being connected mutually as well as being connected to the same nozzle, by means of a nozzle connection hole. A second ink supply port which connects the second pressure generating chamber with the reservoir is positioned nearer to the nozzle opening than the first ink supply port which connects the first pressure generating chamber with the reservoir. In this way, a structure is achieved in which, after an ink droplet has been discharged due to deformation of the piezoelectric element, ink flows into the first pressure generating chamber from a flow path of low flow resistance which passes through the second ink supply port of the second pressure chamber generating chamber.

Furthermore, Japanese Patent Application Publication No. 2001-260347 proposes a composition in which pressure chambers corresponding to nozzles are layered in a tiered structure inside a head, in order to achieve high nozzle density for realizing high-resolution printing.

However, Japanese Patent Application Publication No. 60-115457 has a structure based on a horn shape which causes the traveling ultrasonic wave to converge gradually, and therefore, the displacement amplifying chambers must be of uniform size in all three dimensional directions. This makes it difficult to achieve a high level of integration (high density).

The technology disclosed in Japanese Patent Application Publication No. 2000-43267 provides a complementary flow path (second pressure generating chamber) in the vicinity of each nozzle, in order to increase refilling speed. However, since the individual flow paths from the reservoir to each nozzle cannot actually be shortened, the effect of this structure is limited to improving performance in terms of faster refilling speed.

Japanese Patent Application Publication No. 2001-260347 makes it possible to achieve high nozzle density, but since the distance (flow path length) to the respective nozzle openings from the first and second pressure chambers disposed in a tiered fashion differs between the upper and lower tiers, a problem arises in that the discharge characteristics are different for each tier. In order to achieve uniform discharge characteristics in the upper and lower pressure chambers, it is necessary to design the flow channels individually, or to modify the drive control method accordingly. However, taking into account factors such as assembly precision, temperature characteristics, air bubble accumulation characteristics, and the like, it is extremely difficult to achieve uniform characteristics in the respective pressure chambers.

SUMMARY OF THE INVENTION

The present invention has been contrived in view of the foregoing circumstances, an object thereof being to provide a liquid droplet discharge head and an image forming apparatus using same, whereby discharge efficiency can be improved by amplifying the discharge pressure caused by the displacement of actuators, and furthermore, the speed and reliability of refilling can be improved by shortening the lengths of the individual flow channels.

In order to attain the aforementioned object, the present invention is directed to a liquid droplet discharge head, comprising: a first pressure chamber which is filled with a fluid; an actuator which displaces at least one portion of a surface defining the first pressure chamber; a nozzle which discharges a droplet of a discharge liquid; a second pressure chamber which is connected to the nozzle and is filled with the discharge liquid to be discharged from the nozzle; a liquid supply path which supplies the discharge liquid to the second pressure chamber; and a pressure transmitting section which transmits pressure generated in the first pressure chamber due to driving of the actuator to the second pressure chamber, wherein: taking a surface area of a point of application of a force by the actuator which displaces the first pressure chamber to be S1, and taking a surface area of a point of action of a force applied to the second pressure chamber by means of the pressure transmitting section to be S2, a relationship S1>S2 is satisfied; and the droplet of the discharge liquid is discharged from the nozzle by means of a discharge force being applied to the discharge liquid inside the second pressure chamber through the pressure transmitting section.

According to the present invention, at least one portion of a surface forming the first pressure chamber is displaced by driving an actuator. The pressure generated in accordance with the volume removed by this displacement is transmitted to the second pressure chamber by means of the fluid filled into the first pressure chamber. In this case, since the surface area S1 of the application point where the force generated by the actuator is applied, and the surface area S2 of the pressure transmission section which applies the pressure to the second pressure chamber (namely, the surface area of the point of action), have the relationship S1>S2, then due to the law of conservation of mass in a fluid, the displacement velocity V1 of the actuator section of the first pressure chamber and the displacement velocity V2 of the pressure transmitting section (point of action S2) form the following equation: $V2=V1\times(S1/S2)$, and if the displacement velocity is converted to an amount of displacement per unit time, then the amount of displacement of the actuator section is amplified in the amount of displacement of the pressure transmitting section.

In this way, the displacement generated by the actuator is amplified and transmitted to the second pressure chamber, and due to this transmitted force, the liquid inside the second pressure chamber is pressurized and a liquid droplet is discharged from the nozzle. Accordingly, a structure is obtained in which the second pressure chamber can be pressurized by obtaining a relatively large displacement in a region of small surface area (the surface area S2 of the point of action), and therefore it is possible to achieve a function equivalent to creating an actuator of large displacement. Consequently, liquid of high viscosity can be discharged.

Furthermore, by means of the aforementioned action of increasing the displacement, it is possible to reduce the size of the pressurization surface (pressure transmitting section) of the second pressure chamber in comparison with the prior art, and therefore the second pressure chamber can be made extremely small in size. More specifically, it is possible to arrange the second pressure chambers which are directly linked to the nozzles, at a high density, and therefore, a high nozzle density can be achieved.

Preferably, the liquid droplet discharge head further comprises: a plurality of the nozzles which are arranged in a nozzle row forming a one-dimensional arrangement; and a plurality of the second pressure chambers corresponding to the nozzles which are arranged in a one-dimensional fashion in parallel with the nozzle row in a plane parallel to a discharge surface of the nozzles.

As described above, since the second pressure chambers can be made smaller in size in the present invention, it is possible to achieve a high-density arrangement of the second pressure chambers in one dimension. If a plurality of second pressure chambers are arranged one-dimensionally, then by adopting a composition in which a liquid chamber (common flow channel) for supplying liquid is provided in parallel with the direction of one-dimensional alignment, and discharge liquid is supplied from the liquid chamber to each of the pressure chambers by means of respectively independent liquid supply channels, then it is possible to make the liquid supply channels relatively shorter in length and to achieve uniform lengths. Therefore, refilling properties are improved and high-frequency discharge can be achieved. Furthermore, by shortening the length of the liquid supply channels, air bubble accumulation properties are reduced and reliability is improved.

Preferably, the liquid droplet discharge head further comprises a plurality of the first pressure chambers which are arranged two-dimensionally in a form of staggered matrix in a plane parallel to the discharge surface.

By arranging the first pressure chambers in the form of a two-dimensional matrix, a large surface area can be ensured at the point of application of the force from the actuator which displaces each first pressure chamber, the second pressure chambers can be disposed at high density, and liquid of higher viscosity can be discharged.

Preferably, the nozzle row is formed at a density of 300 npi (nozzles per inch) or above.

By reducing the size of the second pressure chambers according to the present invention, it is possible to align the nozzles in one straight line at a high density of 300 npi or above, which is difficult to achieve in the prior art. By achieving a high-density nozzle arrangement of this kind, it is possible to achieve high-speed recording in a draft mode, or the like. Furthermore, it is also possible to ease the accuracy requirements for the relative alignment between the head and the recording medium. Incidentally, "draft mode" is a mode where droplets are ejected by thinning out the data at a uniform ratio, rather than printing all of the print data constituted by a multiplicity of dots.

Preferably, a high-rigidity section is formed in a boundary section which demarcates a region of the surface area S1 of the point of application from a region of the surface area S2 of the point of application, the high-rigidity section having a higher rigidity than these regions.

The force applied to the surface area (S1) of the point of application is transmitted to the surface area (S2) of the point of action, which is demarcated by a high-rigidity section, and the liquid inside the second pressure chamber is pressurized.

Preferably, a region of the surface area S2 of the point of application is formed on a discharge axis of the nozzle.

As stated previously, in order that the second pressure chamber can be compactified (reduced in surface area), desirably, a structure is adopted in which the region of the surface area of the point of action is situated on the discharge axis of the nozzle, thereby increasing the discharge force applied to the liquid droplets.

Preferably, the first pressure chamber has a closed structure, and the fluid is sealed inside the first pressure chamber.

By forming the first pressure chamber with a closed structure, there are no problems in respect of introduction of air bubbles and reliability can be improved.

Alternatively, it is also preferable that the liquid droplet discharge head further comprises a supply port which supplies the fluid provided in the first pressure chamber.

Instead of forming the first pressure chamber with a closed structure, it is also possible to form the first pressure chamber with a structure which allows fluid to be supplied to the first pressure chamber by means of a supply port.

Preferably, a movable film which separates the fluid from the discharge liquid is provided in the pressure transmitting section, between the first pressure chamber and the second pressure chamber.

A mode is possible in which the first pressure chamber and the second pressure chamber are divided by a movable film, pressure being applied to the second pressure chamber by means of displacement of this movable film. Desirably, a flexible member of low rigidity made of a pliable material that is displaced readily is used for the movable film.

Alternatively, it is also preferable that the first pressure chamber and the second pressure chamber are connected to each other in the pressure transmitting section, and the fluid is a liquid which is immiscible with respect to the discharge liquid.

Instead of providing a movable film between the first pressure chamber and the second pressure chamber, it is also possible to adopt a mode in which the movable film is omitted. For example, another mode is possible in which the member (movable film, or the like) dividing the first pressure chamber and the second pressure chamber is omitted and the first pressure chamber and the second pressure chamber are connected in a pressure transmitting section, a liquid having properties which prevent it from mixing with the discharge liquid being used as the fluid filling the first pressure chamber. According to this composition, when the fluid in the first pressure chamber moves in accordance with the displacement of the actuator, the discharge liquid inside the second pressure chamber is pressed and a liquid droplet is discharged from the nozzle due to this pressure.

Alternatively, it is also preferable that the first pressure chamber and the second pressure chamber are connected to each other in the pressure transmitting section, and the fluid is the same liquid as the discharge liquid.

Instead of the mode using an immiscible fluid, another mode is also possible, in which discharge liquid is supplied to the first pressure chamber. According to this composition, it is possible to supply discharge liquid to the second pressure chamber via the first pressure chamber, and hence the discharge liquid is replaced in a satisfactory manner.

Furthermore, there is no need to introduce fluid previously into the first pressure chamber, and since a fluid lever structure can be achieved by supplying discharge liquid, then manufacture becomes easier.

By omitting the member (movable film or the like) dividing the first pressure chamber and the second pressure chamber, it is possible to minimize driving loss due to deformation of the member, and therefore the discharge force can be applied more efficiently.

Preferably, the fluid is a liquid of viscosity similar to or lower than a viscosity of the discharge liquid.

By using a fluid of low viscosity as the fluid filled into the first pressure chamber, the fluid resistance is reduced and the displacement can be transmitted in an even more efficient manner.

Preferably, the actuator is bonded to a diaphragm which forms a face of the first pressure chamber; and a bonding surface between the actuator and the diaphragm and the surface of the point of action of the force from the pressure transmitting section which acts on the second pressure chamber are formed on the same surface of the diaphragm.

More specifically, since the surface forming the point of application and the surface forming the point of action are provided on the same surface of the same member (the diaphragm), it is possible to form a groove in the member constituting the flow channel of the discharge liquid which makes contact with this surface, in such a manner that a fluid for transmitting the pressure generated by the actuator is introduced into this groove (namely, a groove forming a first pressure chamber). Since this pressure transmission structure can be formed by surface micro-machining, manufacturability is good and the head can be fabricated inexpensively.

In order to attain the aforementioned object, the present invention is also directed to an image forming apparatus, comprising: the above-described liquid droplet discharge head, wherein an image is formed on a recording medium by means of liquid droplets discharged from the nozzles.

For example, the liquid droplet discharge head used in this image forming apparatus achieves a prescribed dot arrangement by causing liquid droplets to be discharged from the liquid droplet discharge openings (nozzles) by controlling the piezoelectric actuators on the basis of image data.

A compositional example of a liquid droplet discharge head is a full line type inkjet head having a nozzle row in which a plurality of nozzles for discharging ink are arranged through a length corresponding to the full width of the recording medium.

In this case, a mode may be adopted in which a plurality of relatively short discharge head blocks having nozzles rows which do not reach a length corresponding to the full width of the recording medium are combined and joined together, thereby forming nozzle rows that correspond to the full width of the recording medium.

A "full-line recording head" is normally disposed along the direction perpendicular to the relative delivering direction of the printing medium (the conveyance direction), but also possible is an aspect in which the recording head is disposed along the diagonal direction given a predetermined angle with respect to the direction perpendicular to the conveyance direction. The arrangement of the image-recording elements in the recording head is not limited to a single row array in the form of a line, but a matrix array composed of a plurality of rows is also possible. Furthermore, also possible is an aspect in which a plurality of short-length recording head units having a row of image-recording elements that do not have lengths that correspond to the entire width of the printing medium are combined and the image-recording element rows are configured so as to correspond to the entire width of the printing medium, with these units acting as a whole.

The "printing medium" is a medium (an object that may be referred to as an image formation medium, recording medium, recorded medium, image receiving medium, or the like) that receives the printing of the recording head, and includes continuous paper, cut paper, seal paper, resin sheets such as sheets used for overhead projectors (OHP), film, cloth, and various other media without regard to materials or shapes.

The term "conveying device" includes an aspect in which the printing medium is conveyed with respect to a stopped (fixed) recording head, an aspect in which the recording head is moved with respect to a stopped printing medium, or an aspect in which both the recording head and the printing medium are moved.

According to the present invention, the movement of liquid inside the first pressure chamber caused by driving of an actuator is utilized and transmitted to a second pressure chamber, in such a manner that a large displacement is applied to the second pressure chamber by means of a pressure transmitting section (surface of action). Therefore, it is possible to perform discharge using a small pressure chamber (second pressure chamber). Therefore, discharge efficiency can be improved. Accordingly, the second pressure chambers can be arranged at a high density and the lengths of the individual liquid supply channels can be shortened and standardized, thereby reducing variations between nozzles, standardizing the discharge characteristics and improving refilling characteristics.

Since the surface area on which gas bubbles can collect is reduced due to the shortening of the liquid supply channels, a structure is achieved in which gas bubbles are not liable to accumulate, while at the same time achieving a structure in which gas bubbles can be expelled readily if they are introduced. Therefore, a highly reliable head can be obtained. Furthermore, since the liquid supply channels are shortened in length, it is possible to suppress the amount of liquid expelled, while also increasing refilling speed and raising the discharge frequency.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
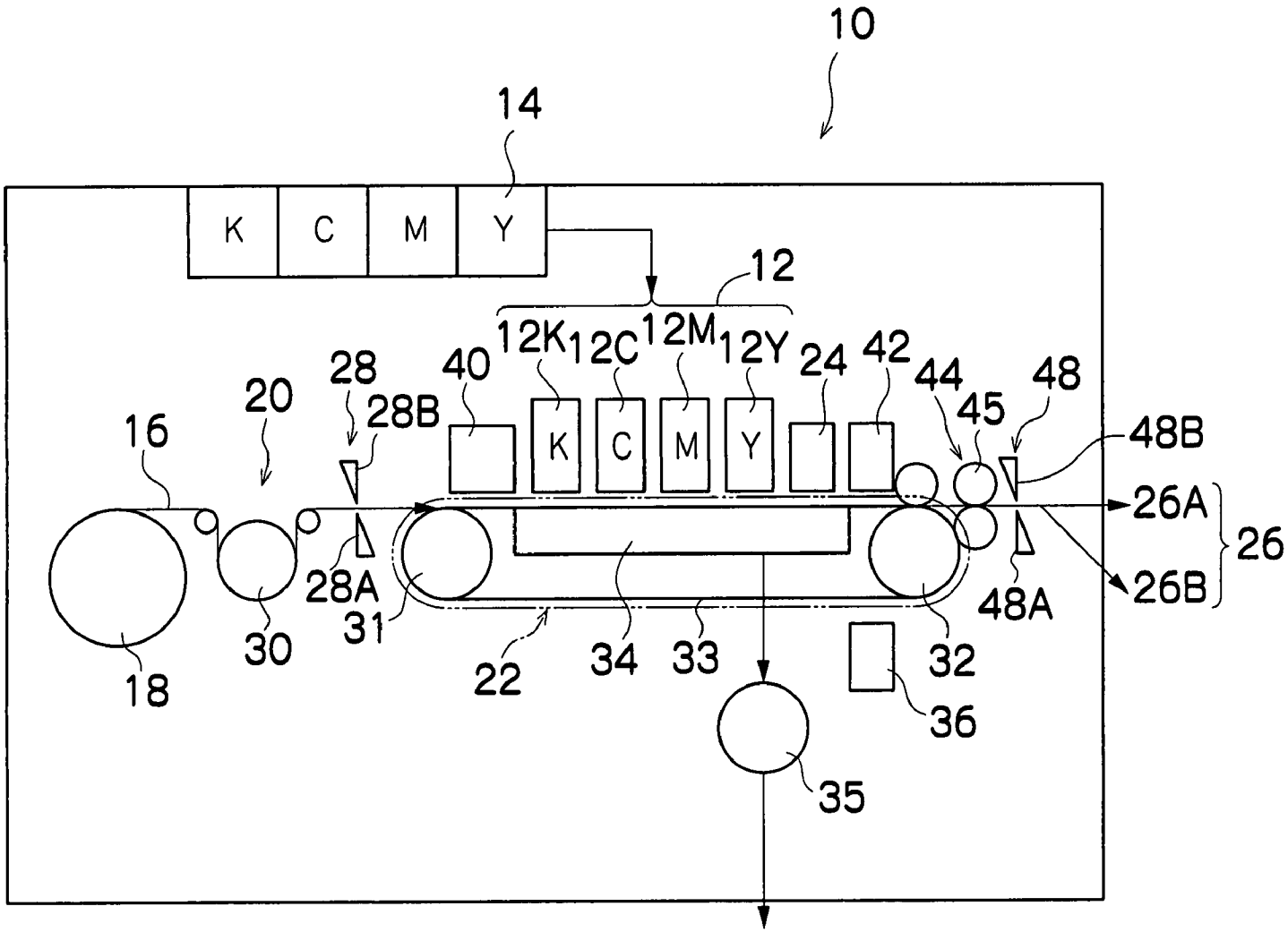
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
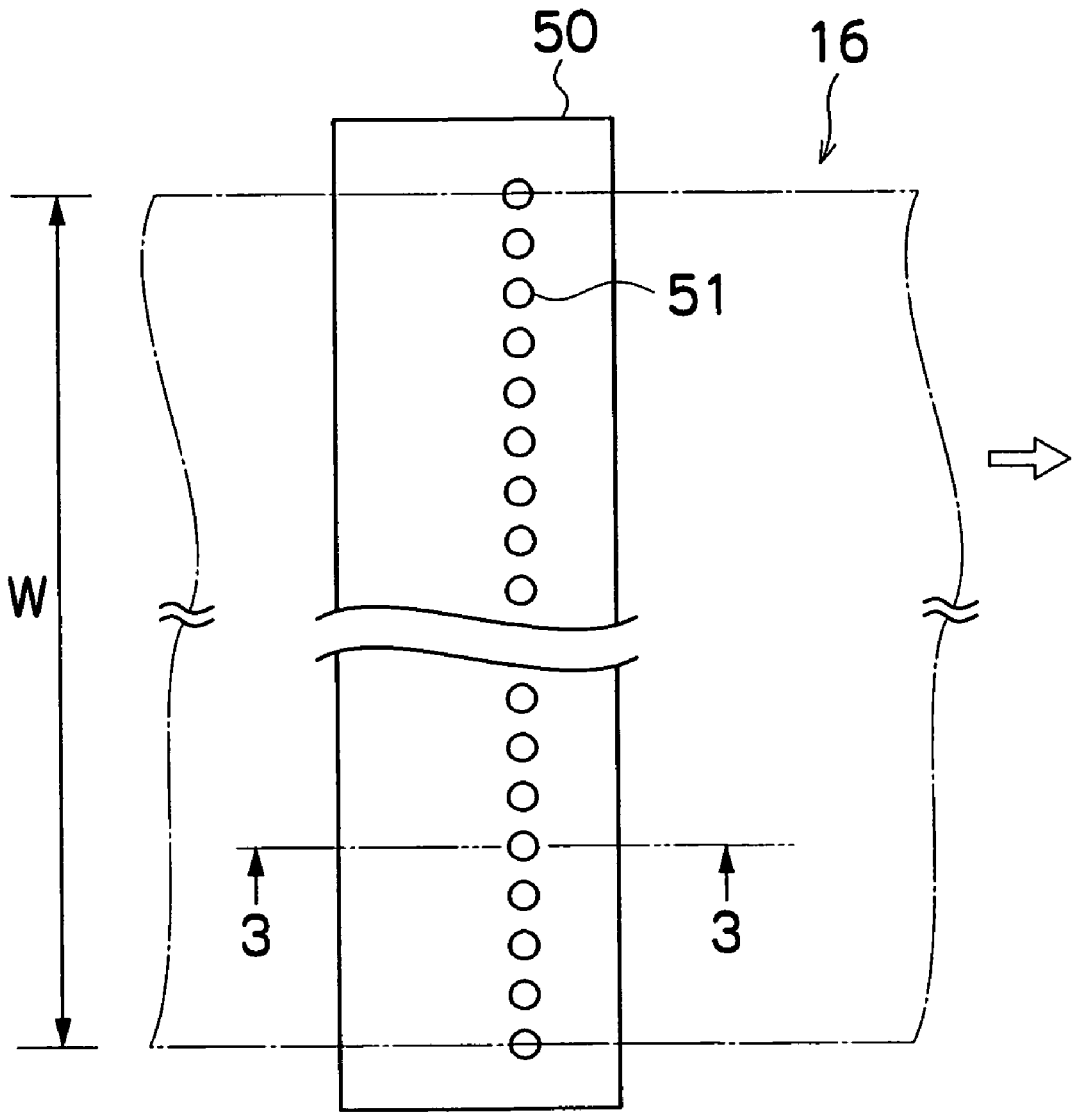
FIG. 2 is a plan diagram (as viewed from the nozzle surface side) showing an example of the nozzle arrangement of a head.

Each of the print heads 12K, 12C, 12M, and 12Y of the printing unit 12 is composed of a so-called full-line head having a length that corresponds to the maximum paper width intended for use in the inkjet recording apparatus 10, in which a plurality of ink-droplet ejection apertures (nozzles) are arranged along a length that exceeds at least one side of the maximum-size recording paper 16 (i.e. along the entire width of the printable area in the recording paper 16, referred to FIG. 2).

The print heads 12K, 12C, 12M, and 12Y are arranged in this order from the upstream side along the direction substantially perpendicular to the delivering direction of the recording paper 16 (hereinafter referred to as the paper conveyance direction).

A color print can be formed on the recording paper 16 by ejecting the inks from the print heads 12K, 12C, 12M, and 12Y, respectively while conveying the recording paper 16 by the suction belt conveyance unit 22.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors. In addition, the arrangement order of the print heads 12K, 12C, 12M, and 12Y is not limited to those.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The details of the ejection determination are described later.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Structure of Print Head

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

FIG. 2 is a plan diagram (as viewed from the nozzle surface side) showing an example of the nozzle arrangement of a head 50. As shown in FIG. 2, the head 50 comprises a nozzle row in which a plurality of nozzles 51 are aligned in one straight line through a length corresponding to the full width of the recording paper 16 in the direction substantially perpendicular to the conveyance direction of the recording paper 16. This diagram provides a schematic illustration, and the nozzles 51 are in fact disposed at a nozzle density of 300 nozzles per inch (300 npi) or greater.

Figure 3A:
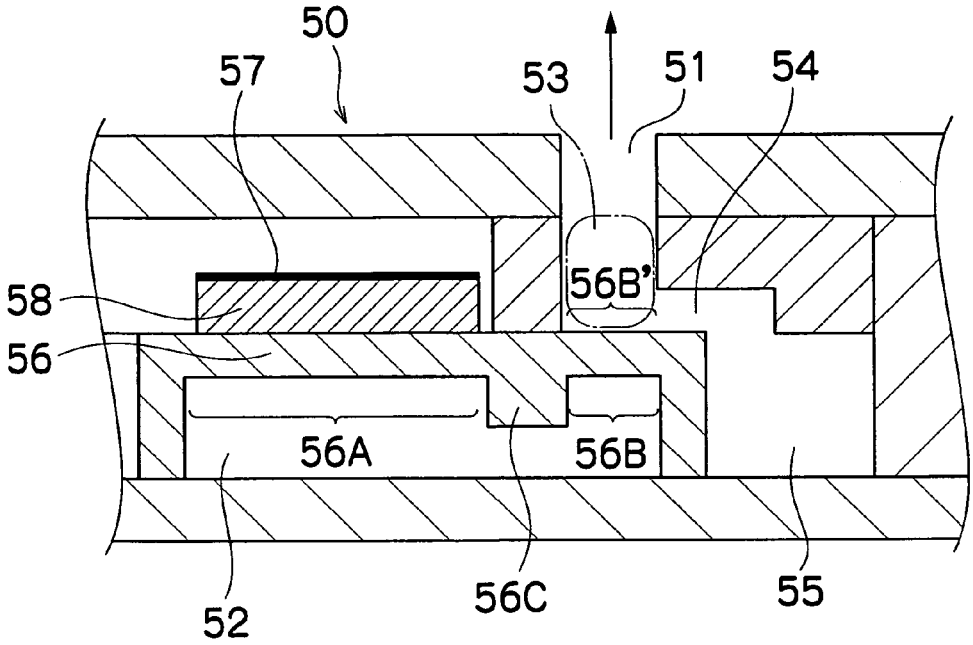
FIG. 3A is a cross-sectional view along line 3-3 in FIG. 2.

FIG. 3A is a cross-sectional diagram (along line 3-3 in the FIG. 2) showing the three-dimensional composition of one of the liquid droplet discharge elements (an ink chamber unit corresponding to one nozzle 51). In FIG. 3A, reference symbol 52 indicates a first pressure chamber and reference symbol 53 indicates a second pressure chamber. The first pressure chamber 52 illustrated in FIG. 3A has a closed structure and a fluid is filled into the first pressure chamber 52. The second pressure chamber 53 is connected to the nozzle 51 and it is also connected to a common flow channel 55 via an individual supply channel 54 for supplying ink.

The common flow channel 55 is connected to an ink tank 60 (not shown in FIG. 3A, but shown in FIG. 6), which is a base tank that supplies ink, and the ink supplied from the ink tank 60 is delivered from the common flow channel 55 in FIG. 3A through the individual supply channel 54 to the second pressure chamber 53 of each nozzle 51.

As shown in FIG. 3A, an actuator 58 provided with an individual electrode 57 is bonded to a diaphragm 56 which forms one face (in the diagram, the ceiling face) of the first pressure chamber 52 (and which also serves as a common electrode). A piezoelectric body, such as a piezo element, is suitable as the actuator 58. The diaphragm 56 comprises a high-rigidity section (restricting section) 56C provided at a boundary section which separates a bonding region 56A of the actuator 58 from a drive action region 56B of the second pressure chamber 53. The high-rigidity section 56C is made to have a high rigidity by being formed to a relatively greater thickness than the bonding region 56A and the drive action region 56B of the diaphragm 56.

When a drive voltage is applied to the individual electrode 57, the actuator 58 deforms and the bonding region 56A of the diaphragm 56 is displaced. The pressure created by this displacement is transmitted to the drive action region 56B by a "fluid lever structure", and the drive action region 56B is displaced, thereby changing the volume of the second pressure chamber 53. Ink is discharged from the nozzle 51 by means of the pressure change caused by the deformation of the second pressure chamber 53. When ink is discharged, new ink is supplied to the second pressure chamber 53 from the common flow channel 55 via the individual supply channel 54.

The head 50 having the structure illustrated in FIG. 3A may be manufactured by layering together and bonding a plurality of plate members created by forming holes or grooves in a thin plate member of stainless steel plate (SUS plate), or the like, by means of etching, pressing, micro-machining, or other such techniques.

Figure 3B:
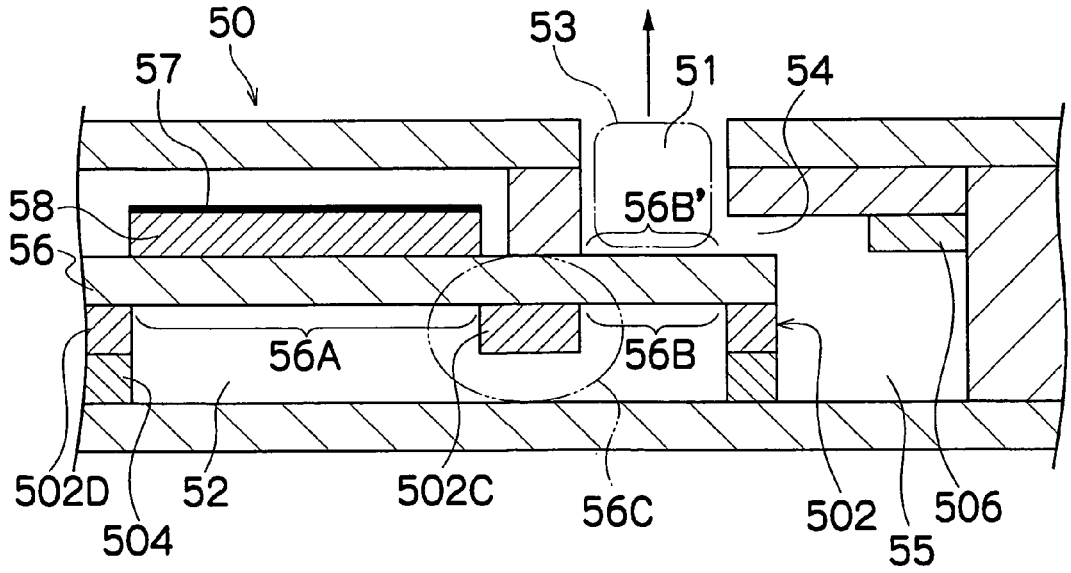
FIG. 3B is a cross-sectional diagram showing a further example of the structure of a liquid droplet discharge element.

FIG. 3B shows a further example of the structure of a liquid droplet discharge element. In this diagram, parts which are the same or similar to those of FIG. 3A are labeled with the same reference numerals, and description thereof is omitted. In the example shown in FIG. 3B, a plate member 502 is bonded to the surface of the diaphragm 56 adjacent to the first pressure chamber 52. A portion 502C of the plate member 502 forms a high-rigidity section 56C in conjunction with the diaphragm 56 (this high-rigidity section being indicated by the double-dotted line in the diagram).

In FIG. 3B, reference numeral 504 denotes a flow channel plate member which forms the walls of the first pressure chamber 52 in conjunction with a portion 502D of the plate member 502. Reference numeral 506 is a flow channel plate member for forming the individual supply channel 54.

Description of Fluid Lever Structure

Figure 4:
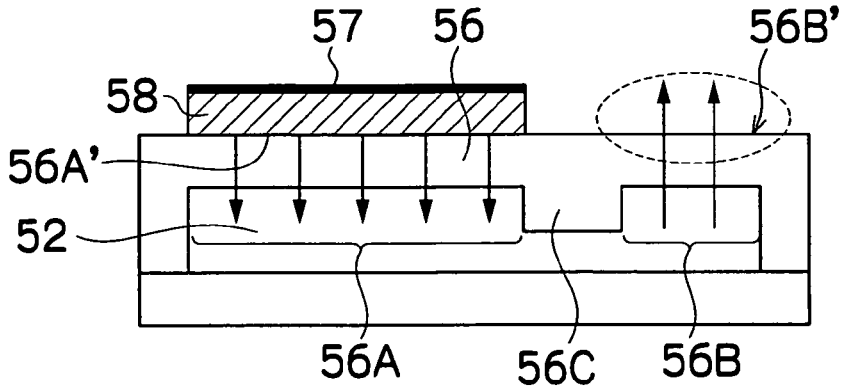
FIG. 4 is a hypothetical model diagram for describing the principles of a fluid lever structure.

Here, a "fluid lever" is described with reference to FIG. 4, in order to provide a readily comprehensible explanation of the law of conservation of mass in a fluid. FIG. 4 shows a hypothetical model of an extracted view of the portion of FIGS. 3A and 3B which corresponds to a fluid lever. The actuator 58 and the diaphragm 56 in FIGS. 3A and 3B are depicted in the same fashion as the actuator 58 and diaphragm 56 in FIG. 4.

The drive action region 56B (corresponding to the pressure transmitting section) which acts on the second pressure chamber 53 in FIGS. 3A and 3B is also indicated by the reference symbol 56B in FIG. 4. In FIG. 4, the bonding surface 56A' between the actuator 58 and the diaphragm 56 corresponds to the point of pressure application. Furthermore, the surface 56B' on the outer side of the drive action region 56B corresponds to the point of action. (In FIGS. 3A and 3B, this corresponds to the surface of the drive action region 56B on the side adjacent to the second pressure chamber 53).

Taking the surface of the point of application corresponding to the bonding region 56A to be S1, the displacement velocity thereof to be V1, the surface area of the point of action corresponding to the surface 56B' on the outer side of the drive action region 56B to be S2, and the displacement velocity thereof to be V2, the equation for the conservation of mass in a fluid is given by the following equation (1):

$$S1 \times V1 = S2 \times V2, \tag{1}$$

and taking the amount of displacement of the point of application per unit time to be L1, and the amount of displacement of the point of action to be L2, then the following equation (2):

$$L2 = L1 \times (S1/S2) \tag{2}$$

is obtained. By means of this structure, the force generated by the actuator 58 is transmitted to the second pressure chamber 53 by means of the "lever function" of the first pressure chamber 52. The displacement generated by the "(large surface area)×(small stroke)" at the point of application in the first pressure chamber 52 becomes a "(small surface area)×(long stroke)" at the point of action (56B'), where it is transmitted to the second pressure chamber 53. In other words, the region marked by the dotted line in FIG. 4 is used as a pressurizing actuator section for the second pressure chamber 53.

The portion of the drive surface illustrated by reference numeral 56B' may be constituted by the same material as the diaphragm 56, or it may be constituted by a low-rigidity film, or the like, that is readily displaceable.

Figure 5:
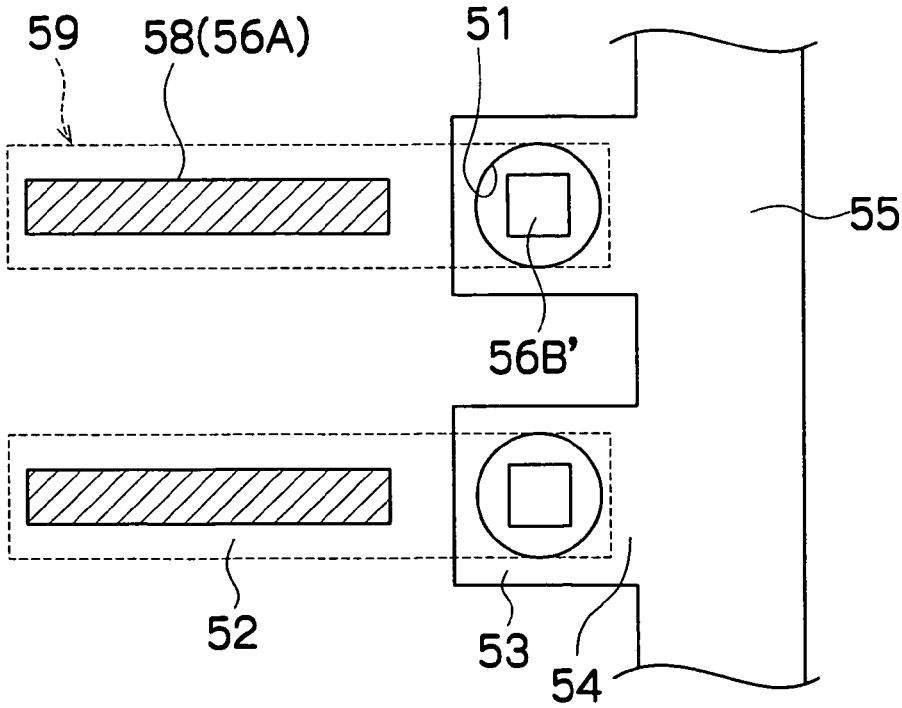
FIG. 5 is a schematic plan diagram showing an example of the arrangement of a fluid lever structure in the head according to the present example.

FIG. 5 is a plan diagram showing an example of the arrangement of a fluid lever structure in a head 50 according to the present example. In FIG. 5, the region marked by the broken line in FIG. 5 (reference numeral 59) corresponds to the first block of the fluid lever structure illustrated in FIG. 4. As shown in FIG. 5, by distributing the fluid lever structure 59 in a two-dimensional layout within a plane parallel to the nozzle surface, it is possible to achieve high-density distribution of the nozzle rows. By means of this arrangement, it is possible to provide connections to the individual electrodes 57 of the actuators 58 within the same layer in the head 50. Therefore, the head is easy to manufacture and reduction in manufacturing costs can be achieved.

Furthermore, the common flow channel 55 is formed in parallel to the direction in which the second pressure chambers 53 are aligned, and the lengths of the individual supply channels 54 branching from the common flow channel 55 to each respective second pressure chamber 53 are substantially the same, and they are relatively short.

In order that the refill operation after discharge can be completed in a short period of time, and in order to prevent stagnation in the flow channels and increase the expulsion of air bubbles, dust, and the like, it is desirable that the flow channel length of the individual supply channels 54 be approximately several tens of μm or less.

In this way, according to the present embodiment, it is possible to arrange the nozzles 51 for discharge at high density in a state where the flow channel characteristics are substantially equal for each nozzle 51. Therefore, it is possible to prevent variations between nozzles.

Furthermore, by means of the fluid lever structure 59, the ink pressurization surface area of the second pressure chamber 53 (the surface area S2 of the point of action) can be reduced, and therefore impediments caused by compositions having a broad pressurization surface can be resolved. More specifically, the surface area on which air bubbles can accumulate and adhere is reduced by the shortening of the flow channel lengths, and therefore, reliability is improved. Furthermore, the refilling flow channel is shortened by the shortening of the individual supply channels, and therefore discharge frequency can be increased and printing productivity can be raised.

Figure 8A:
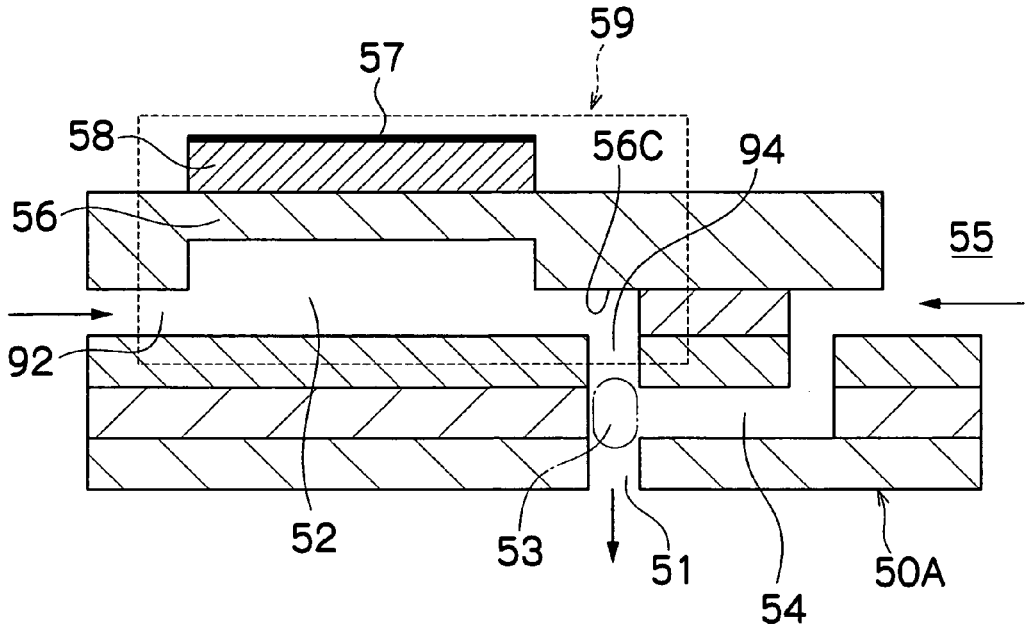
FIG. 8A is a cross-sectional diagram showing an example of the structure of a head according to a first additional embodiment of the present invention.
Figure 8B:
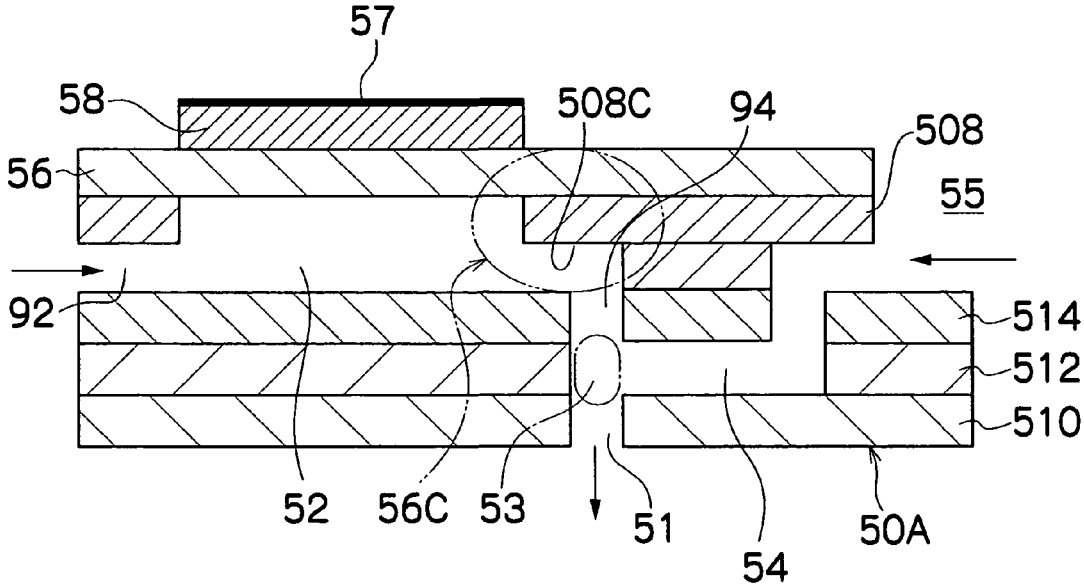
FIG. 8B is a cross-sectional diagram showing a modification of the structure illustrated in FIG. 8A.

In FIGS. 3A and 3B, a closed structure filled with fluid is adopted for the first pressure chamber 52, but the first pressure chamber 52 does not necessarily have to have a closed structure. Furthermore, in FIGS. 3A and 3B, a drive surface member for transmitting pressure (the region indicated by reference numeral 56B) is provided between the first pressure chamber 52 and the second pressure chamber 53, but it is also possible to adopt a composition in which the member for separating the two pressure chambers is omitted. An example of a non-closed structure of this kind is described hereafter (FIGS. 8A and 8B).

Configuration of Ink Supply System

Figure 6:
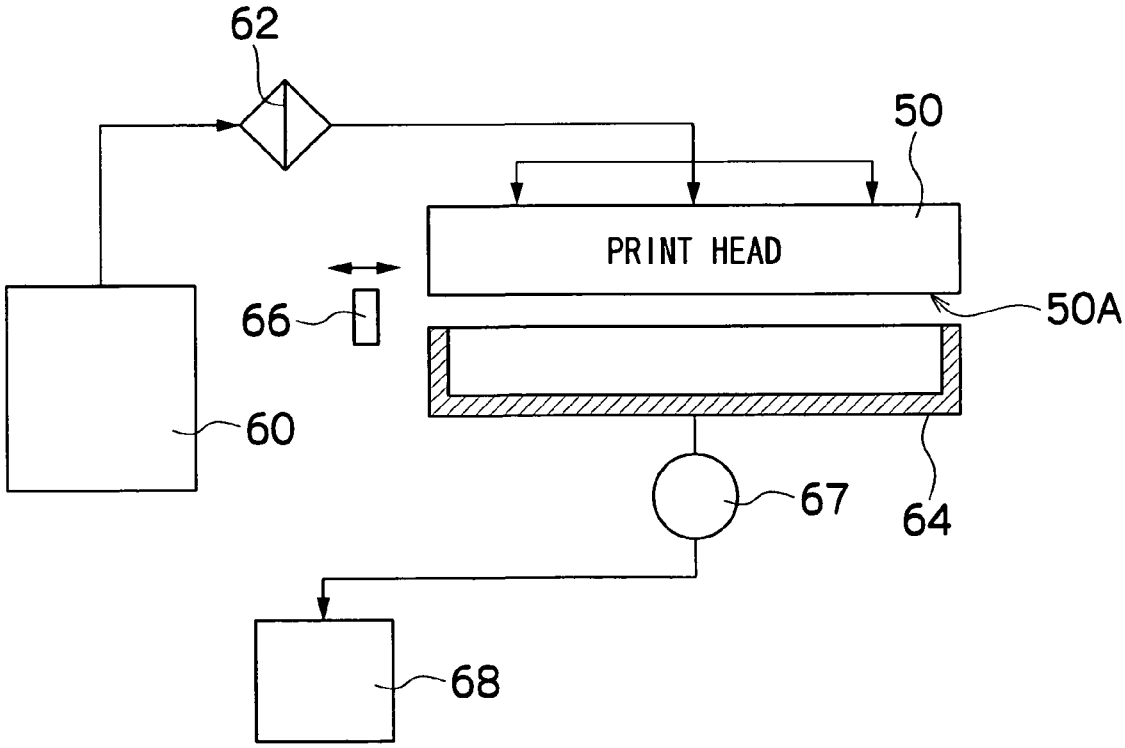
FIG. 6 is a schematic drawing showing the composition of an ink supply system in the inkjet recording apparatus according to the present example.

FIG. 6 is a schematic drawing showing the configuration of the ink supply system in the inkjet recording apparatus 10. An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary ejection is made toward the cap 64 to eject the degraded ink.

Also, when bubbles have become intermixed in the ink inside the print head 50 (inside the second pressure chamber 53), the cap 64 is placed on the print head 50, ink (ink in which bubbles have become intermixed) inside the pressure chamber 52 is removed by suction with a suction pump 67, and the suction-removed ink is sent to a collection tank 68. This suction action entails the suctioning of degraded ink of which viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state the actuator 58 is operated (in a viscosity range that allows ejection by the operation of the actuator 58), and the preliminary ejection is made toward the ink receptor to which the ink of which viscosity has increased in the vicinity of the nozzle is to be ejected. After the nozzle surface 50A is cleaned by a wiper such as the cleaning blade 66 provided as the cleaning device for the nozzle face 50A, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on.

When bubbles have become intermixed in the nozzle 51 or the second pressure chamber 53, or when the ink viscosity inside the nozzle 51 has increased over a certain level, ink can no longer be ejected by the preliminary ejection, and a suctioning action is carried out as follows.

More specifically, when bubbles have become intermixed in the ink inside the nozzle 51 and the second pressure chamber 53, ink can no longer be ejected from the nozzles even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face 50A of the print head 50, and the ink in which bubbles have become intermixed or the ink of which viscosity has increased is removed by suction.

However, this suction action is performed with respect to all the ink in the second pressure chamber 53, so that the amount of ink consumption is considerable. Therefore, a preferred aspect is one in which a preliminary ejection is performed when the increase in the viscosity of the ink is small.

Description of Control System

Figure 7:
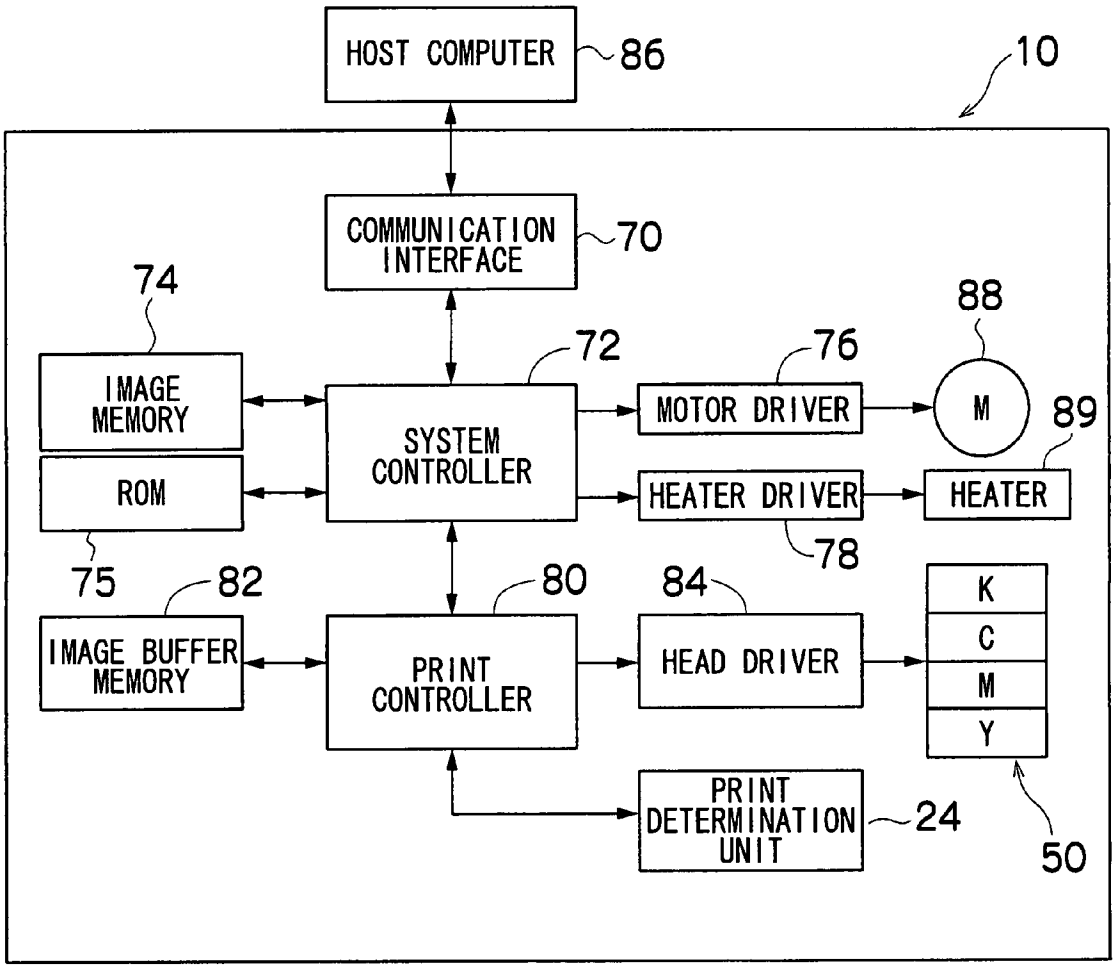
FIG. 7 is a principal block diagram showing the system composition of an inkjet recording apparatus according to the present example.

FIG. 7 is a block diagram of the principal components showing the system configuration of the inkjet recording apparatus 10. The inkjet recording apparatus 10 has a communication interface 70, a system controller 72, an image memory 74, ROM 75, a motor driver 76, a heater driver 78, a print controller 80, an image buffer memory 82, a history information storing unit 83, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 functions as a control device for controlling the whole inkjet recording apparatus 10 in accordance with a prescribed program, and it also functions as a calculating device for performing various types of calculations. More specifically, the system controller 72 is constituted by a central processing unit (CPU), peripheral circuits relating to same, and the like. The system controller 72 controls respective units, such as the communications interface 70, image memory 74, ROM 75, motor driver 76, and the like, and it also controls communications with the host computer 86 and read and write operations to and from the image memory 74, ROM 75, and the like, as well as generating control signals for controlling the conveyance motor 88 and the heater 89.

The ROM 75 stores programs executed by the CPU of the system controller 72, various data required for control procedures, and the like. It is preferable that the ROM 75 is a non-rewriteable storage device, or a rewriteable storage device such as an EEPROM. The image memory 74 is used as a temporary storage region for image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print controller 80, and the discharge amount and the discharge timing of the ink droplets from the respective print heads 50 are controlled via the head drier 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 (corresponding to the ejection drive device) for the print head 50 of each color on the basis of the print data received from the print controller 80. A feedback control system for keeping the drive conditions for the print heads constant may be included in the head driver 84.

The image data to be printed is externally inputted through the communications interface 70, and is stored in the image memory 74. At this stage, RGB image data is stored in the image memory 74.

The image data stored in the image memory 74 is sent to the print controller 80 through the system controller 72, and is converted to the dot data for each ink color by a known dithering algorithm, random dithering algorithm or another technique in the print controller 80. The print head 50 converts the dot data thus generated by the print controller 80 into dot data for each ink color. In other words, the print controller 80 performs processing for converting the input RGB image data into dot data for four colors, KCMY. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to the head 50, ink is discharged from the head 50. By controlling ink discharge from the heads 50 in synchronization with the conveyance speed of the recording paper 16, an image is formed on the recording paper 16.

As shown in FIG. 1, the print determination unit 24 is a block including a line sensor, which reads in the image printed onto the recording paper 16, performs various signal processing operations, and the like, and determines the print situation (presence/absence of discharge, variation in droplet ejection, etc.), these determination results being supplied to the print controller 80.

Furthermore, according to requirements, the print controller 80 makes various corrections with respect to the head 50 on the basis of information obtained from the print determination unit 24. Furthermore, the system controller 72 implements control for carrying out preliminary discharge, suctioning, and other prescribed restoring processes, on the basis of the information obtained from the discharge determination unit 24.

Additional Embodiment 1

FIG. 8A shows a further example of the structure of a liquid droplet discharge element. In FIG. 8A, items which are the same as or similar to those in FIG. 3A are labeled with the same reference numerals and description thereof is omitted here.

In the structure illustrated in FIG. 8A, liquid is discharged from the nozzles 51 in the downward direction in the drawing. A liquid supply port 92 is formed in the first pressure chamber 52, and a fluid (pressure transmitting fluid) is supplied to the first pressure chamber 52 via this liquid supply port 92.

Furthermore, the first pressure chamber 52 is connected to the second pressure chamber 53 by means of a connecting hole 94 (corresponding to a pressure transmitting section), and there is no member which divides the first pressure chamber 52 from the second pressure chamber 53 (namely, no member corresponding to the displaceable diaphragm member or film indicated by reference numeral 56B in FIG. 3A.

The second pressure chamber 53 is a space formed at the region of confluence of the connecting hole 94 and the individual supply channel 54, and it is positioned on the discharge axis of the nozzle 51 (in other words, directly above the nozzle 51).

In the structure shown in FIG. 8A, the fluid supplied from the liquid supply port 92 to the first pressure chamber 52 may be ink of the same properties as the ink supplied to the second pressure chamber 53, or it may be a liquid other than ink. If a liquid other than ink is used, then desirably, a liquid which does not mix with ink (an immiscible liquid) is used. If a liquid which does not mix with ink is used, then desirably, the fluid has a viscosity similar to or lower than the ink. In this way, the efficiency with which the displacement is transmitted can be increased yet further.

According to this structure, liquid is filled into a first pressure chamber 52 from a liquid supply port 92, and when a diaphragm 56 of the first pressure chamber 52 is displaced by means of an actuator 58, the liquid inside the first pressure chamber 52 moves and the liquid inside the second pressure chamber 53 moves by a large amount in the direction of the nozzle 51. Due to the force of this movement of liquid, the liquid inside the second pressure chamber 53 is pushed out and is discharged from the nozzle 51.

In this way, by omitting a partition member which divides the first pressure chamber 52 from the second pressure chamber 53, it is possible to minimize drive loss caused by deformation of such a partition member, and therefore discharge efficiency can be increased. If ink (one liquid) is filled into both the first pressure chamber 52 and the second pressure chamber 53, then it is possible to omit either the liquid supply port 92 or the individual supply channel indicated by reference numeral 54 in FIG. 8A. Desirably, in view of refilling performance, it is preferable to omit the liquid supply port 92.

FIG. 8B is a modification example of the structure shown in FIG. 8A. In FIG. 8B, parts which are the same as or similar to those in FIG. 8A are labeled with the same reference numerals and described thereof is omitted. In the example shown in FIG. 8B, the plate member 508 is bonded to the surface of the diaphragm 56 on the side adjacent to the first pressure chamber 52, and a portion 508C of the plate member 508 forms a high-rigidity section 56C (the section marked by the double-dotted line in the diagram) in conjunction with the diaphragm 56. In FIG. 8B, reference numeral 510 is a nozzle plate and reference numeral 512 and 514 are respective flow channel plate members for forming necessary flow channels.

Additional Embodiment 2

Figure 9:
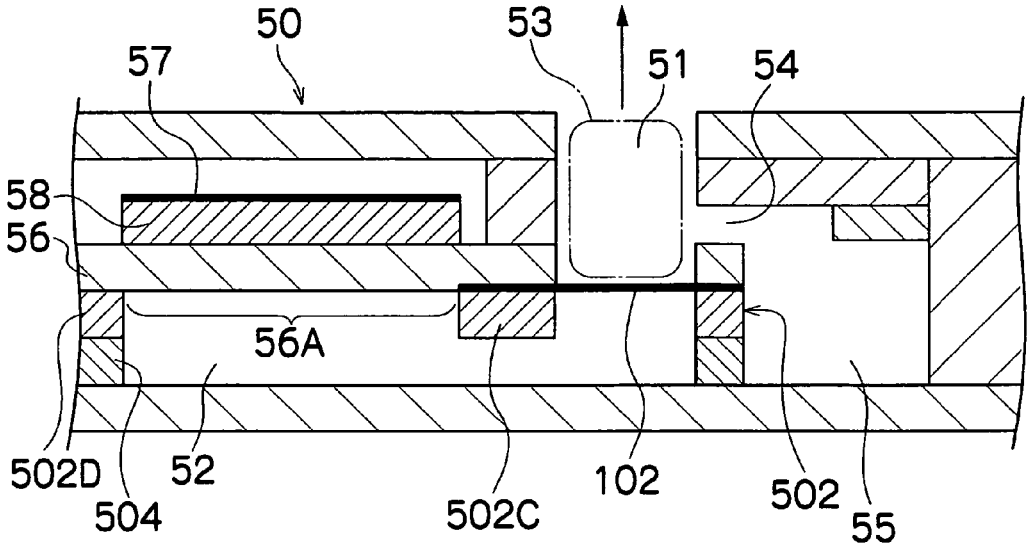
FIG. 9 is a cross-sectional diagram showing an example of the structure of a head according to a second additional embodiment.

FIG. 9 is a diagram showing an example of a structure in which a movable film is provided instead of the drive surface member for transmitting pressure in FIG. 8B (the portion indicated by reference numeral 56B). In FIG. 9, parts which are the same as or similar to those in FIG. 3B are labeled with the same reference numerals and description thereof is omitted. In the example shown in FIG. 9, a movable film 102 which divides the first pressure chamber 52 from the second pressure chamber 53 is provided between the two pressure chambers. The movable film 102 is disposed in a position corresponding to the pressure transmitting section, and it is inserted in between the diaphragm 56 and the plate member 502 and bonded to same. This movable film 102 is made of a film-shaped resin, and desirably, it is made of a polyimide resin film having sufficient heat resistance to withstand the heating and bonding process.

Additional Embodiment 3

Figure 10:
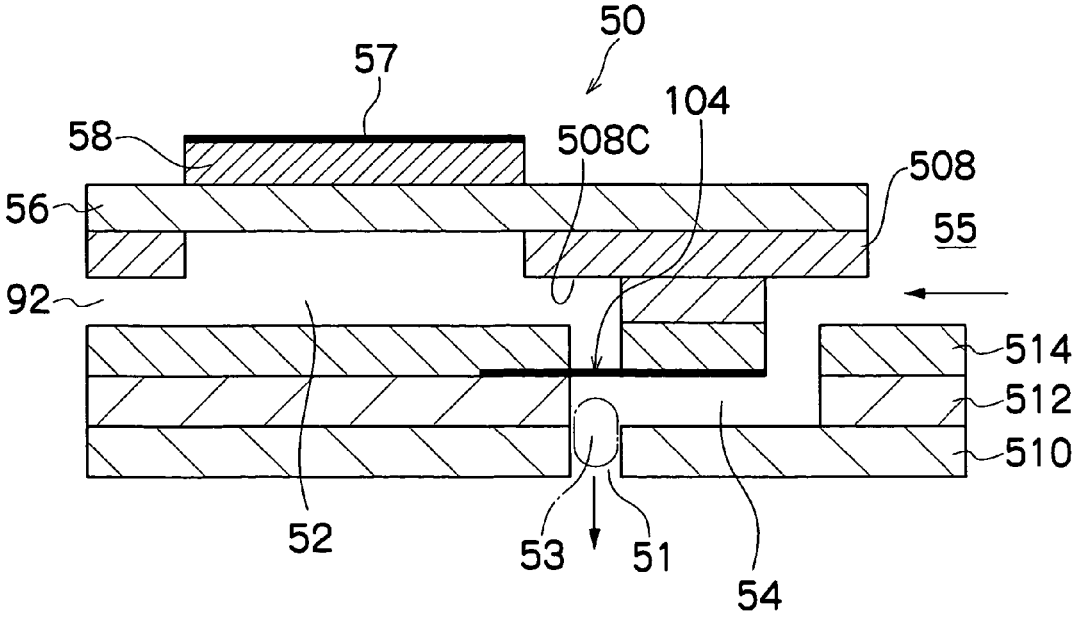
FIG. 10 is a cross-sectional diagram showing an example of the structure of a head according to a third additional embodiment.

FIG. 10 is a diagram showing a structural example in which a movable film 104 which divides the first pressure chamber 52 from the second pressure chamber 53 is provided between the pressure chambers. In FIG. 10, parts which are the same as or similar to those in FIG. 8B are labeled with the same reference numerals and description thereof is omitted. A desirable material for the movable film 104 is similar to the movable film 102 illustrated in FIG. 9. In the example shown in FIG. 10, a movable film 104 is bonded to the channel plate member 514, and pressure is transmitted from the liquid in the first pressure chamber 52 to the liquid in the second pressure chamber 53 by means of displacement of the movable film 104.

Additional Embodiment 4

Figure 11:
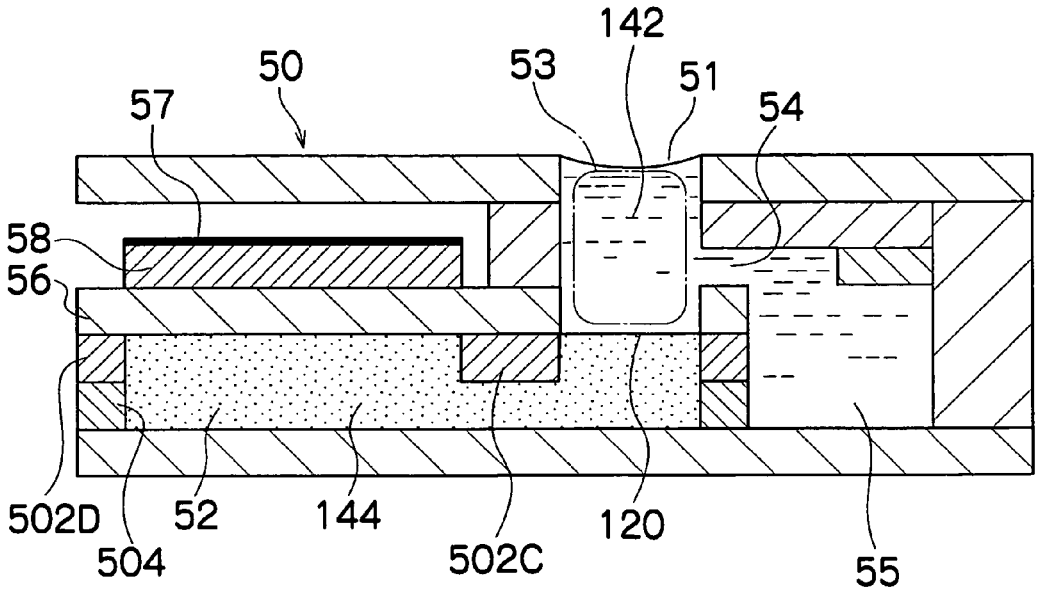
FIG. 11 is a cross-sectional diagram showing an example of the structure of a head according to a fourth additional embodiment.
Figure 12:
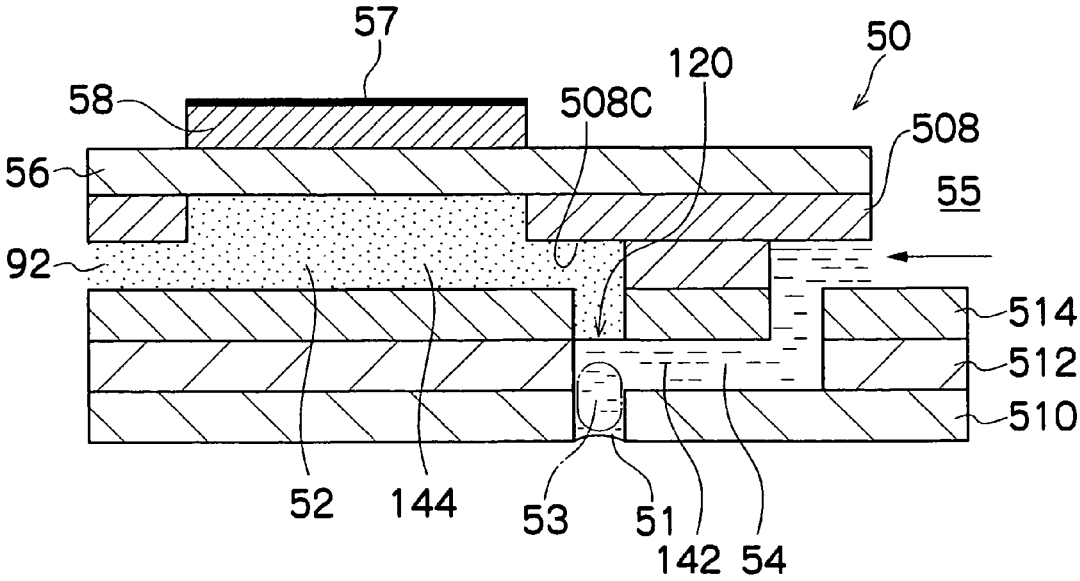
FIG. 12 is a cross-sectional diagram showing a modification of the structure illustrated in FIG. 8B.

FIG. 11 and FIG. 12 show modes in which the movable films 102 and 104 are omitted from the structural examples shown in FIG. 9 and FIG. 10, and a liquid of different properties to the ink for discharging (namely, the liquid filled into the second pressure chamber 53) is used in the first pressure chamber 52. In FIG. 11 and FIG. 12, parts which are the same as or similar to those in FIG. 9 and FIG. 10 are labeled with the same reference numerals and further description thereof is omitted here.

Reference numeral 120 in FIG. 11 and FIG. 12 shows the boundary surface between two types of liquid. For example, in one possible mode, a water-based ink 142 is used as the ink for discharging, and an oil 144 of a separate phase to the water-based ink 142 is used as the medium of the fluid lever. According to this composition, the oil 144 inside the first pressure chamber 52 moves with the displacement of the actuator 58, thereby pushing the ink 142 inside the second pressure chamber 53, and a liquid droplet is discharged from the nozzle 51 by means of this pressure.

Alternatively, a mode is possible in which an oil-based ultraviolet-curable ink is used as the ink for discharging, and water, which has a separate phase to this oil-based ultraviolet-curable ink is used as the medium of the fluid lever. The ink viscosity of the oil-based ultraviolet curable ink is several tens cP, and by using a liquid having lower viscosity than this (in this case, water), for the medium of the fluid lever, it is possible to increase the displacement transmission efficiency.

Additional Embodiment 5

Figure 13:
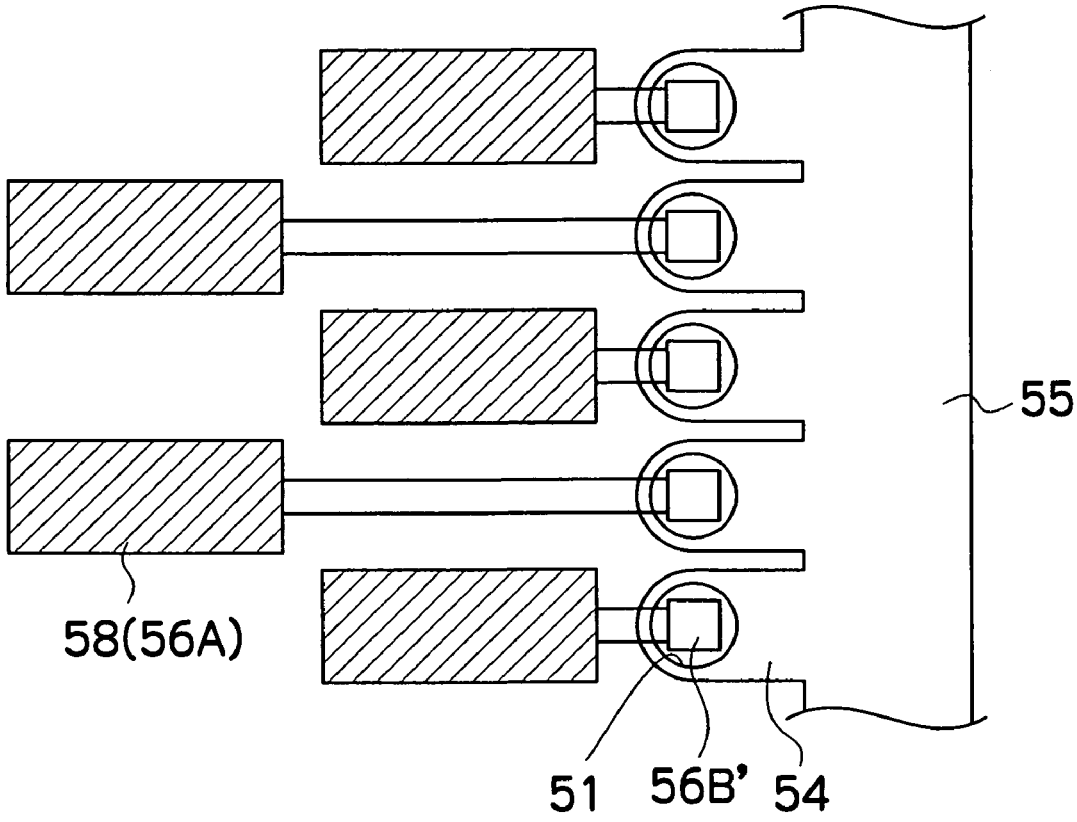
FIG. 13 is a schematic plan diagram showing a further example of the arrangement of a fluid lever structure.

In FIG. 5, the first pressure chambers 52 are arranged one-dimensionally in a row, but when implementing the present invention, it is also possible to adopt a mode in which the first pressure chambers 52 are arranged two-dimensionally in a staggered matrix, as illustrated in FIG. 13. In FIG. 13, items which are the same as or similar to those in FIG. 5 are labeled with the same reference numerals and description thereof is omitted here. According to the composition shown in FIG. 13, it is possible to arrange the second pressure chambers 53 and the nozzles 51 one-dimensionally at a high density.

More specifically, it is possible to arrange the actuators 58, which function as pressure application points, in a two-dimensional array, and to arrange the pressurization surfaces (56B') of the second pressure chambers 53, which form the points of action, in a one-dimensional fashion. The individual supply channels 54 which branch from the common flow channel 55 may be constituted by a flow channel structure which has the same flow length for each nozzle. Therefore, it is possible to achieve uniform nozzle-to-nozzle cross-talk characteristics and refilling performance.

Additional Embodiment 6

Figure 14:
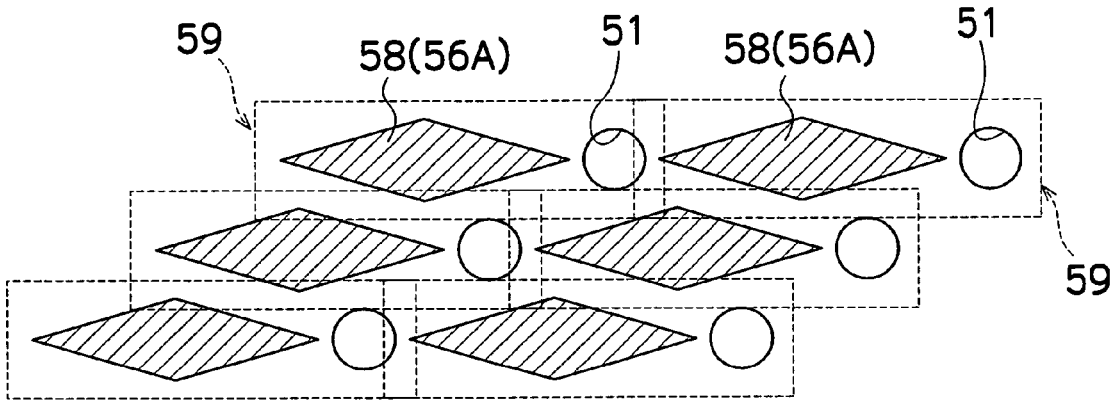
FIG. 14 is a principal schematic plan diagram showing a compositional example in which nozzles are arranged in a two-dimensional array.

In implementing the present invention, the arrangement of the nozzles is not limited to a one-dimensional nozzle row, and as shown in FIG. 14, it is also possible to adopt a composition in which the nozzles are arranged two-dimensionally by arranging the fluid lever structures in the form of a two-dimensional matrix. In FIG. 14, items which are the same as or similar to those in FIG. 5 are labeled with the same reference numerals and description thereof is omitted here.

In the example in FIG. 14, the plan shape of the actuators 58 is an approximate diamond shape, and in accordance with this, the plan shape of the first pressure chambers 52 is also an approximate diamond shape. The rectangular regions indicated by the broken lines in FIG. 14 (reference numeral 59) show the range of the fluid lever structure, and the regions of the points of action (56B') are located at the positions of the nozzles 51 (in other words, on the discharge axis of the nozzles 51).

The blocks of the fluid lever structures 59 corresponding to the respective nozzles 51 are situated in a tiered fashion at different heights in the direction perpendicular to the plane of the drawings, in such a manner that adjacent blocks situated in different tiers are partially overlapping. By adopting an arrangement structure of this kind, it is possible to achieve yet higher density.

Of course, it is also possible to adopt a composition in which the fluid lever structures are arranged two-dimensionally in the same plane, rather than a composition in which the respective fluid lever structures are disposed at a high density in a tiered arrangement.

Figure 15A:
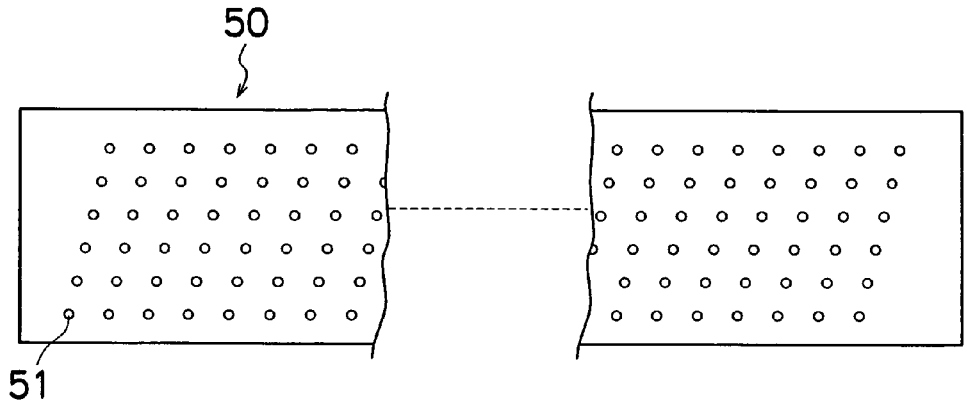
FIGS. 15A and 15B are plan diagrams showing an example of the composition of a full line head based on a two-dimensional nozzle arrangement.

By achieving a two-dimensional arrangement of the nozzles 51 by means of a structure such as that illustrated in FIG. 14, it is possible to achieve a full line head having a two-dimensional nozzle arrangement structure such as that illustrated in FIG. 15A.

Figure 15B:
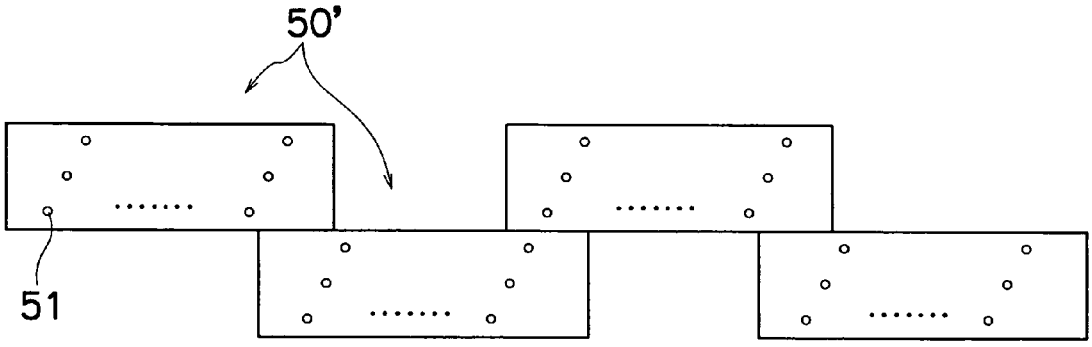

Furthermore, as shown in FIG. 15B, it is also possible to compose a full line type head having nozzle rows of a length corresponding to the full width of the recording medium, by joining together a number of short head blocks 50', wherein a plurality of nozzles 51 are arranged in a two-dimensional fashion, in a matrix arrangement.

In the respective embodiments described above, an inkjet recording apparatus using a page-wide full line type head having a nozzle row of a length corresponding to the entire width of the recording medium has been described, but the scope of application of the present invention is not limited to this, and the present invention may also be applied to an inkjet recording apparatus using a shuttle head which performs image recording while moving a short recording head reciprocally.

Moreover, in the foregoing explanation, an inkjet recording apparatus has been described as one example of an image forming apparatus, but the scope of application of the present invention is not limited to this. For example, the liquid droplet discharge head according to the present invention may also be applied to a photographic image forming apparatus in which developing solution is applied to a printing paper by means of a non-contact method. Furthermore, the scope of application of the liquid droplet discharge head according to the present invention is not limited to an image forming apparatus, and the present invention may also be applied to various other types of apparatuses which spray a processing liquid, or other liquid, toward an ejection receiving medium by means of an ejection head (such as a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet discharge head, comprising:

a first pressure chamber which is filled with a fluid;

an actuator which displaces at least one portion of a surface defining the first pressure chamber and which includes a piezoelectric element;

a plurality of nozzles which discharge droplets of a discharge liquid;

a plurality of second pressure chambers which are connected to the plurality of nozzles and are filled with the discharge liquid to be discharged from the plurality of nozzles;

a common flow channel which accommodates the discharge liquid to be supplied to the plurality of second pressure chambers;

a plurality of individual supply channels which connect the plurality of second pressure chambers with the common flow channel, the discharge liquid being supplied from the common flow channel to the plurality of second pressure chambers through the plurality of individual supply channels; and a pressure transmitting section which transmits pressure generated in the first pressure chamber due to driving of the actuator to the plurality of second pressure chambers, wherein:

taking a surface area of a point of application of a force by the actuator which displaces the first pressure chamber to be S1, and taking a surface area of a point of action of a force applied to each of the plurality of second pressure chambers by means of the pressure transmitting section to be S2, a relationship S1>S2 is satisfied; and the droplets of the discharge liquid are discharged from each of the plurality of nozzles by means of a discharge force being applied to the discharge liquid inside each of the plurality of second pressure chambers through the pressure transmitting section.

2. The liquid droplet discharge head as defined in claim 1, wherein:

the plurality of nozzles are arranged in a nozzle row forming a one-dimensional arrangement; and the plurality of second pressure chambers corresponding to the nozzles are arranged in a one-dimensional fashion in parallel with the nozzle row in a plane parallel to a discharge surface of the nozzles.

3. The liquid droplet discharge head as defined in claim 2, wherein the nozzle row is formed at a density of 300 npi (nozzles per inch) or above.

4. The liquid droplet discharge head as defined in claim 1, wherein a high-rigidity section is formed in a boundary section which demarcates a region of the surface area S1 of the point of application from a region of the surface area S2 of the point of application, the high-rigidity section having a higher rigidity than these regions.

5. The liquid droplet discharge head as defined in claim 1, wherein a region of the surface area S2 of the point of application is formed on a discharge axis of each of the plurality of nozzles.

6. The liquid droplet discharge head as defined in claim 1, wherein the first pressure chamber has a closed structure, and the fluid is sealed inside the first pressure chamber.

7. The liquid droplet discharge head as defined in claim 1, wherein the first pressure chamber has a supply port through which the fluid is supplied to the first pressure chamber.

8. The liquid droplet discharge head as defined in claim 7, wherein the first pressure chamber and the plurality of second pressure chambers are connected to each other in the pressure transmitting section, and the fluid is the same liquid as the discharge liquid.

9. The liquid droplet discharge head as defined in claim 1, wherein a movable film which separates the fluid from the discharge liquid is provided in the pressure transmitting section, between the first pressure chamber and the plurality of second pressure chambers.

10. The liquid droplet discharge head as defined in claim 1, wherein:

the actuator is bonded to a diaphragm which forms a face of the first pressure chamber; and a bonding surface between the actuator and the diaphragm and the surface of the point of action of the force from the pressure transmitting section which acts on the plurality of second pressure chambers are formed on the same surface of the diaphragm.

11. An image forming apparatus, comprising:

the liquid droplet discharge head as defined in claim 1, wherein an image is formed on a recording medium by means of liquid droplets discharged from the plurality of nozzles.

12. The liquid droplet discharge head as defined in claim 1, wherein:

the plurality of nozzles are arranged in a nozzle row forming a one-dimensional arrangement;

the plurality of second pressure chambers corresponding to the nozzles are arranged in a one-dimensional fashion in parallel with the nozzle row in a plane parallel to a discharge surface of the nozzles; and a plurality of the first pressure chambers are arranged two-dimensionally in a form of staggered matrix in a plane parallel to the discharge surface.

13. The liquid droplet discharge head as defined in claim 1, wherein:

the first pressure chamber has a supply port through which the fluid is supplied to the first pressure chamber, and the first pressure chamber and each of the plurality of the second pressure chambers are connected to each other in the pressure transmitting section, and the fluid is a liquid which is immiscible with respect to the discharge liquid.

14. The liquid droplet discharge head as defined in claim 1, wherein the fluid is a liquid of viscosity similar to or lower than a viscosity of the discharge liquid.

15. The liquid droplet discharge head as defined in claim 1, further comprising a plurality of the first pressure chambers which are arranged two-dimensionally in a staggered matrix, wherein the plurality of second pressure chambers are arranged one-dimensionally.

16. The liquid droplet discharge head as defined in claim 15, wherein the plurality of second pressure chambers are arranged one-dimensionally along the common flow channel, and the plurality of individual supply channels have a same length.

17. The liquid droplet discharge head as defined in claim 16, wherein each of the plurality of nozzles is disposed between the common flow channel and corresponding one of the plurality of first pressure chambers.

18. A liquid droplet discharge head, comprising:

a first pressure chamber which is filled with a fluid;

an actuator which displaces at least one portion of a surface defining the first pressure chamber;

a nozzle which discharges a droplet of a discharge liquid;

a second pressure chamber which is connected to the nozzle and is filled with the discharge liquid to be discharged from the nozzle;

a liquid supply path which supplies the discharge liquid to the second pressure chamber; and a pressure transmitting section which transmits pressure generated in the first pressure chamber due to driving of the actuator to the second pressure chamber, wherein:

taking a surface area of a point of application of a force by the actuator which displaces the first pressure chamber to be S1, and taking a surface area of a point of action of a force applied to the second pressure chamber by means of the pressure transmitting section to be S2, a relationship S1>S2 is satisfied;

the droplet of the discharge liquid is discharged from the nozzle by means of a discharge force being applied to the discharge liquid inside the second pressure chamber through the pressure transmitting section;

the first pressure chamber has a supply port through which the fluid is supplied to the first pressure chamber; and the first pressure chamber and the second pressure chamber are directly connected to each other in the pressure transmitting section, and the fluid is a liquid which is immiscible with respect to the discharge liquid.

19. A liquid droplet discharge head, comprising:

a first pressure chamber which is filled with a fluid;

an actuator which displaces at least one portion of a surface defining the first pressure chamber;

a nozzle which discharges a droplet of a discharge liquid;

a second pressure chamber which is connected to the nozzle and is filled with the discharge liquid to be discharged from the nozzle;

a liquid supply path which supplies the discharge liquid to the second pressure chamber; and a pressure transmitting section which transmits pressure generated in the first pressure chamber due to driving of the actuator to the second pressure chamber, wherein:

taking a surface area of a point of application of a force by the actuator which displaces the first pressure chamber to be S1, and taking a surface area of a point of action of a force applied to the second pressure chamber by means of the pressure transmitting section to be S2, a relationship S1>S2 is satisfied;

the droplet of the discharge liquid is discharged from the nozzle by means of a discharge force being applied to the discharge liquid inside the second pressure chamber through the pressure transmitting section; and the fluid is a liquid of viscosity similar to or lower than a viscosity of the discharge liquid, wherein the first pressure chamber and the second pressure chamber are directly connected to each other.

* * * * *